US006869002B2

(12) United States Patent
Eigenmann

(10) Patent No.: US 6,869,002 B2
(45) Date of Patent: Mar. 22, 2005

(54) APPARATUS FOR A INTERMITTENT FEEDING OF A STRIP SHAPED BLANK TO A PRESS AND A METHOD OF OPERATING SAME

(75) Inventor: Oskar Eigenmann, Arbon (SE)

(73) Assignee: Bruderer AG, Frasnacht (CH)

( * ) Notice: Subject to any disclaimer, the term of this patent is extended or adjusted under 35 U.S.C. 154(b) by 5 days.

(21) Appl. No.: 10/402,281

(22) Filed: Mar. 28, 2003

(65) Prior Publication Data

US 2004/0004102 A1 Jan. 8, 2004

(30) Foreign Application Priority Data

Jul. 8, 2002 (EP) ..... 02015172

(51) Int. Cl.[7] ..... B65H 20/00
(52) U.S. Cl. ..... 226/154; 152/155
(58) Field of Search ..... 226/152, 154, 226/155, 90, 35

(56) References Cited

U.S. PATENT DOCUMENTS 3,638,846 A 2/1972 Wiig ..... 226/142
4,792,074 A * 12/1988 Bareis et al. ..... 226/149
5,062,561 A 11/1991 Messner ..... 226/152
5,163,595 A 11/1992 Messner ..... 226/154
5,197,645 A * 3/1993 Nordlof ..... 226/154
5,868,296 A * 2/1999 Gentile et al. ..... 226/35
5,992,722 A 11/1999 Strick et al. ..... 226/152
6,662,988 B2 * 12/2003 Eigenmann ..... 226/142

* cited by examiner

*Primary Examiner*—Emmanuel Marcelo
*Assistant Examiner*—Evan H Langdon
(74) *Attorney, Agent, or Firm*—Ladas & Parry LLP

(57) ABSTRACT

An adjusting nut is arranged on a threaded spindle and supports a first double arm lever unit with a first and a second arm. A second double arm lever unit is pivotally mounted at its first arm through a connecting strip to the second arm of the first double arm unit. The second arm of the second double arm unit is pivotally mounted through a control rod unit to a rocker. This rocker supports upper feeding roller which co-operates with a lower feeding roller for a feeding of a strip shaped blank. The first arm of the first double arm unit supports a bolt which projects into an elongate hole of an eccentrically supported rod.

7 Claims, 11 Drawing Sheets

49
48
51
52
54
53
113
55
56
67
102
103
96
93
57
97
94
58
59
50
112
60
104
69
74
101
95
71
84
75
73
79
33b
11
13
10
9
7
B
33
82
23
22
1
81
21
25

APPARATUS FOR A INTERMITTENT FEEDING OF A STRIP SHAPED BLANK TO A PRESS AND A METHOD OF OPERATING SAME

CROSS REFERENCE TO RELATED APPLICATIONS

This present application is based on the European Patent Application Serial No. 02 015 172.6 filed on Jul. 8, 2002, of which the priority is claimed and the disclosure of which shall be considered included in this application by reference.

BACKGROUND OF THE INVENTION

1. Field of the Invention

The present invention relates to an apparatus for intermitted feeding of strip shaped blank to a punch press which is equipped with tools adapted for intermittent working of the strip shaped blank, which feeding apparatus includes a housing and a threaded spindle housing arranged on said housing, an upper shaft assembly and an upper feeding roller mounted on said upper shaft assembly, a lower shaft assembly and a lower feeding roller mounted on said lower shaft assembly, which feeding rollers are adapted to grip said blank to be fed by clamping the blank at both its sides and to feed the blank intermittently by an intermittent rotational movement, of which shaft assemblies at least one is drivingly connected to a an intermittently operating electric servomotor and the upper shaft assembly is supported in a rocker which is pivotally mounted at said housing through a rocker shaft, by means of which rocker said upper shaft assembly is moveable towards and away from said lower shaft assembly.

The invention relates further to a method of operating said feeding apparatus, which feeding apparatus includes further a control apparatus and cooperates with a press which has a moveable upper tool and a stationary lower tool, which upper tool is mounted to a punch which is moveable between a top dead center position and a bottom dead center position, and comprises a press control apparatus which communicates with the control apparatus of the feeding apparatus and comprises further a rod having an elongate hole and which is moveable between a top dead center position and a bottom dead center position, and having a bolt extending through the elongate hole, whereby in order to insert a fresh strip shaped blank between the upper feeding roller and the lower feeding roller the upper feeding roller is moved into a high lift position in order to set a predetermined distance between the upper feeding roller and the lower feeding roller.

The invention relates further to the method of operating the feeding apparatus, which feeding apparatus comprises a control apparatus and cooperates with a press which has a moveable upper tool and a stationary lower tool, which upper tool is mounted to a punch which is moveable between a top dead center position and a bottom dead center position, and which comprises a press control apparatus which communicates with the control apparatus of the feeding apparatus and comprises further a rod which is movable between a top dead center position and a bottom dead center position, which rod has an elongate hole having a upper and a lower end whereby the first arm of the first double arm lever unit engages the rod by a bolt extending through the elongate hole.

The invention relates also to a method of operating the feeding apparatus as set forth above, which feeding apparatus has a control apparatus and cooperates with a press which has a moveable upper tool and a stationary lower tool, which upper tool is mounted to a punch which is moveable between a top dead center position and a bottom dead center position, and which has a press control apparatus which communicates with the control apparatus of the feeding apparatus, and has further a rod which is moveable between a top dead center position and a bottom dead center position, which rod has an elongate hole having a upper and a lower end, whereby the first arm of the first double arm lever unit engages the rod by a bolt extending through the elongate hole.

The invention relates also to a method of operating the feeding apparatus set forth above, wherein the feeding apparatus comprises a control apparatus and cooperates with a press which has a moveable upper tool and a stationary lower tool, which upper tool is mounted to a punch which is moveable between a top dead center position and a bottom dead center position, and which comprises a press control apparatus which communicates with the control apparatus of the feeding apparatus, and comprises further a rod which is moveable between a top dead center position and a bottom dead center position, which rod has an elongate hole having a upper and a lower end, whereby the first arm of the first double arm lever unit engages the rod by a bolt extending through the elongate hole which punch is driven by a rotating drive and the eccentric disc of the rod is driven by a drive motor, which upper tool has positioning pins for a precise positioning of the strip shaped blank in the press during the working of same, which positioning pins are moved into pre-punched positioning holes in the strip shaped blank and which positioning pins include a conical head portion, which upper feeding roller is moved away from the bottom feeding roller as soon as the conical head portions are moved partly into the positioning holes and thereafter set again onto the strip shaped blank as soon as the conical head portions have been lifted partly out of the positioning holes.

2. Description of the Prior Art

The punch presses referred to herein are especially high speed presses with stroke numbers up to 2000 strokes per minute. These presses are equipped with tools for a working of a (or several) fed strip shaped blank(s), whereby punching operations, embossing operations, bending operations, a riveting, a producing of threads, etc. are performed.

The movement of the strip shaped blank which is processed in the press proceeds, thereby, intermittently, thus step by step. During a working step, e.g. a punching, quite obviously no feeding movement of the strip shaped blank occurs. It is often positioned precisely, thus arrested by positioning pins located in the tools. After the termination of the processing step, for instance after a punching tool has been moved out of the hole which has been punched through, the strip shaped blank is fed forwards by a set distance and is again stopped, so that the next subsequent processing step can be performed.

The feeding or advancing, resp. movement of the strip shaped blank is accomplished by a (or several, located at the entry and the exit of the press) feeding or forwarding, resp. apparatus (or apparatuses, resp.) in order to draw the strip shaped intermittently off a storage spool and feed same intermittently to the press.

These feeding apparatuses comprise conventionally feeding members in order to feed and forward the strip shaped blank. It is, thereby, clamped and moved forward by the feeding members. When the feeding members return into their initial, that is starting position, the clamping is released.

Additionally, the clamping is temporarily released during the time span, during which the tools perform a processing or working, resp. step of the strip shaped blank, specifically in case of positioning pins.

Designs of such feeding apparatuses have become known, in which the clamping members are designed as linearly moving clamping tongues. Other designs comprise oscillating segment rollers which perform rotational movements.

Furthermore, feeding apparatuses with electrical servomotors have become known. A first servomotor is, thereby, allocated to the feeding operation of the clamping members and a further, second electric servomotor is allocated to the intermittent lifting of a clamping member off the strip shaped blank. Such servomotors are produced and sold by several companies. The operation of these servomotors is electronically controlled. These new feeding apparatuses comprise feeding members in form of completely cylinder shaped feeding rollers mounted on shafts which rotate intermittently always in the same sense of rotation. Of these feeding rollers one is supported in a structural member which is drivingly connected to the further servomotor, based on the operation of which this feeding roller is moved against the strip shaped blank for a clamping of same and away from this member for a releasing of same.

Due to the presently extremely high number of strokes, the masses of the moving parts of a feeding apparatus have a large impact due to the forces of inertia and the moments of inertia, and have, furthermore, a large influence regarding the precision of the produced product. Furthermore, due to the time spans for the acceleration and deceleration of movements, the arrangement and design of the moving parts must be selected in such a manner, that an operation of a high number of strokes can be performed safely.

SUMMARY OF THE INVENTION

Hence, it is a general object of the present invention to provide a apparatus for an intermittent feeding of a strip shaped blank which has a minimum of moving parts, whereby those parts which are subject to high accelerations and decelerations have as small as possible masses, and in which no driving motors are present which operate in a oscillating manner.

A further object of the invention is to provide a apparatus for an intermittent feeding of a strip shaped blank, of which its housing includes a threaded spindle housing in which a threaded spindle is located, which threaded spindle is firmly mounted to a sleeve member which is supported through roller bearings free of play in the threaded spindle housing, so that the threaded spindle is supported free of play in the threaded spindle housing.

Still a further object is to provide a apparatus for an intermittent feeding of a strip shaped blank, in which the sleeve part which is firmly mounted to the threaded spindle is part of a multi-part clamping sleeve into which the drive shaft of a electric servomotor projects, so that during the assembling of the electric servomotor the final position of the electric servomotor is determined by a connecting of its drive shaft to the threaded spindle through the clamping sleeve by the threaded spindle which is precisely supported in the threaded spindle housing.

Yet a further object of the invention is to provide a apparatus for an intermittent feeding of a strip shaped blank which comprises a motor with a threaded spindle and a control apparatus, an adjusting nut arranged on the threaded spindle and adapted to be moved along the spindle by a rotational movement of the spindle; a drive motor and an eccentric disc drivingly coupled to the drive motor, a rod supported on the eccentric disc, which rod has at an end remote from the eccentric disc an elongate hole extending at least approximately parallel to the threaded spindle; a first double arm lever unit supported on the adjusting nut and a second double arm lever unit supported on a shaft which in turn is supported in the threaded spindle housing; which first double arm lever unit includes a first arm which engages the rod and includes a second arm which is pivotally mounted to a connecting strip which in turn is pivotally mounted to a first arm of the second double arm lever unit which has a second arm which is pivotally mounted to a control rod unit which in turn is pivotally mounted to the rocker; and comprises a pressure spring assembly arranged between the rocker and the threaded spindle housing, which pressure spring assembly is adapted to press the rocker with the upper shaft assembly and with the upper feeding roller supported therein onto the lower shaft assembly with the lower feeding roller.

A further object of the invention is to provide a method of operating a feeding apparatus, in which in order to set a high lift position of the upper feeding roller its two control apparatuses are controlled in such a manner, that the ram is controlled to move into its top dead center position and the rod is controlled to move into its bottom center position.

Still a further object of the invention is to provide a method of operating a feeding apparatus for setting a high lift position of its upper feeding roller, wherein the ram is kept stationary and the adjusting nut is lowered by a rotating of the threaded spindle, whereby the bolt comes to lie onto the lower end of the elongate hole due to the force exerted by the pressure spring assembly via the rocker and the lever units, so that the first arm of the first double arm lever unit is pivoted downwards, the first arm of the second double arm lever unit is pivoted downwards and the second arm is pivoted upwards, so that the control rod unit is lifted due to these pivoting movements and accordingly the rocker with the upper feeding roller supported therein is pivoted upwards into the high lift position of the feeding roller.

Yet a further object of the invention is to provide a method of operating a feeding apparatus set forth above, in which the rod is moved into its bottom dead center position, the adjusting nut is moved downwards by a rotating of the threaded spindle until the upper feeding roller comes to lie on the strip shaped blank due to the pressure exerted by the pressure springs onto the rocker, thereafter the adjusting nut is moved still further downwards until the bolt is at a distance from both ends of the elongate hole, so that the stroke movements of the rod are possible at a stationary state of the bolt.

A further object of the invention is to provide a method of operating a feeding apparatus set forth above, wherein in order to set the intermediate lift position, the punch is brought by its rotating drive into a angular position ahead of its bottom dead center position, in which angular position the conical head portions of the positioning pins project only partly into the positioning holes, in which state the eccentric disc of the rod attains a angular position ahead of the top dead center position, whereby the angular distance of the punch between said angular position and the bottom dead center position equals the angular distance of the eccentric disc between its said angular position and the top dead center position, and wherein thereafter the adjusting nut is moved downwards, so that the bolt comes to rest onto the bottom end of the elongate hole and the adjusting nut is moved still more further down until the strip shaped blank is loose due to the lifting off of the upper feeding roller by the movement transmitted through the lever units and the control rod assembly and rocker, and wherein the position attained by the adjusting nut for mentioned angular position of the eccentric disc and the corresponding angular position of the punch are stored in the corresponding control apparatus.

Due to the design of the clamping sleeve which is an integral part of the threaded spindle, there is the liberty of selecting and mounting various different electric servomotors and specifically standard motors because no custom produced drive shafts of such electrical servomotors are necessary.

Basically, the design of the feeding apparatus must fulfill three main functions, namely high lifting (inserting strip), adjusting in accordance with the thickness of the strip (the upper roller lies on the strip, play in the elongate hole of the rod) and intermediate lifting (strip lifting ahead of each punching operation).

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
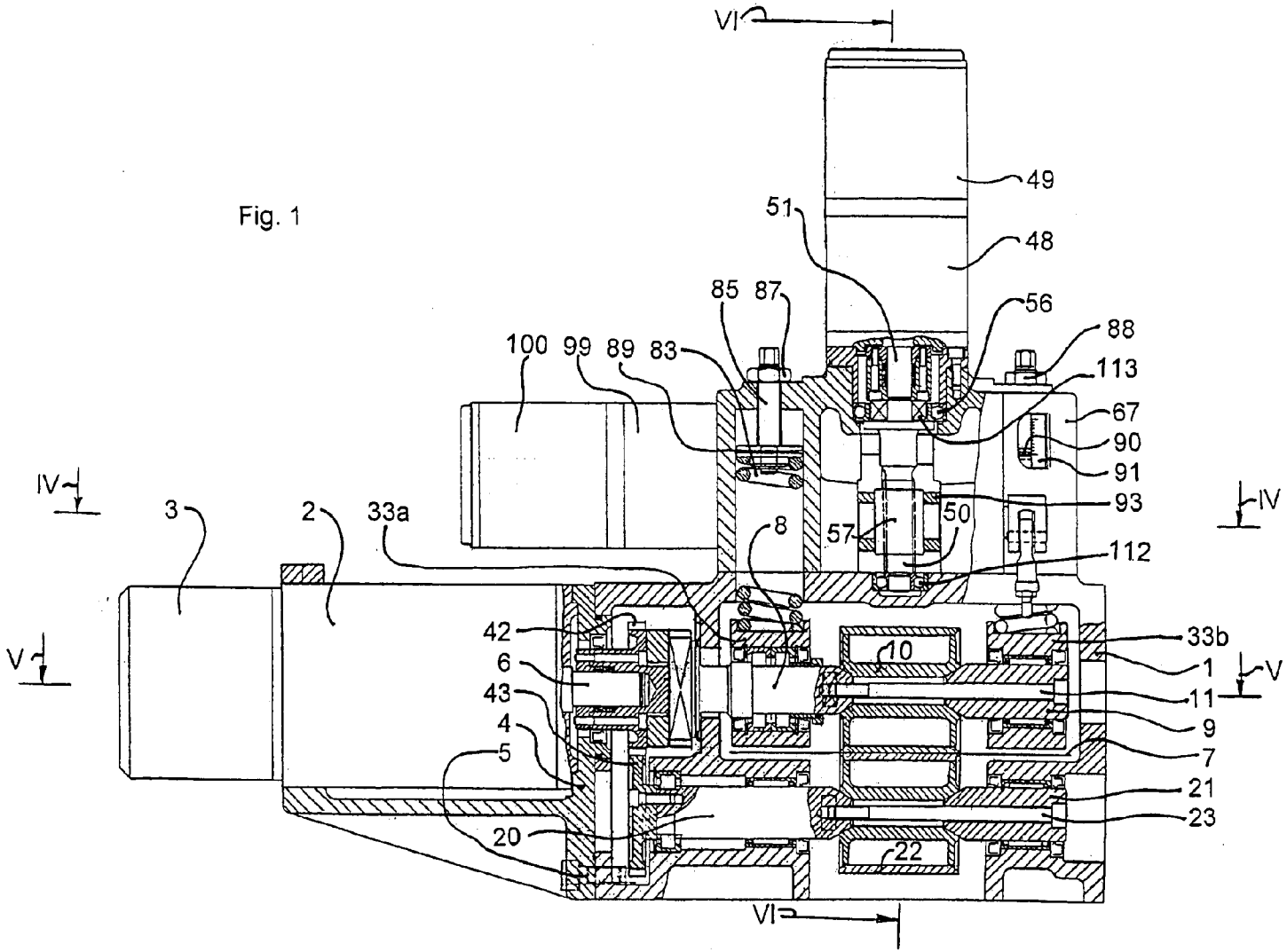
FIG. 1 is a section through a first embodiment of the apparatus according to the present invention.

The apparatus has a frame 1. A first electric servomotor 2, of which the electronic control 3 is shown in a simplified manner is mounted at its flange 4 through threaded bolts 5 to the frame 1.

This first electric servomotor 2 is controlled in a manner which as such is generally known so that it performs step-wise intermittent rotational movements. The duration and the extent of a respective step of the rotational movement are controlled in dependence from the working process to be done in the adjacent following punch press. This electric servomotor 2 includes a drive shaft 6.

An upper shaft assembly 8, 9 with upper feeding roller 10 and a lower shaft assembly 20, 21 with a lower feeding roller 22 are located in the frame 1, which feeding rollers 10, 22 are to feed the strip shaped blank 7, generally a metal strip, in an intermittent fashion.

The upper shaft assembly 8, 9 is composed of a first shaft portion 8 located axially adjacent the electric servomotor 2, and of a second shaft portion 9 located axially at a distance from the first shaft portion 8 and remote from the electric servomotor 2. The upper feeding roller 10 is held between these two shaft portions 8, 9 in a clamped state.

A threaded tightening bolt 11 extends axially through the second shaft portion 9 located remote from the electric servomotor 2, which threaded tightening bolt 11 rests against the second shaft portion 9 and is threadingly engaged in the first shaft portion 8 located adjacent the electric servomotor 2.

The two shaft portions 8, 9 are held tightened against each other by this threaded tightening bolt 11, so that the upper feeding roller 10 which is located between these shaft portions 8, 9 is firmly held between the two shaft portions 8, 9 in a clamped state.

This upper feeding roller 10 which consists of several parts and is of a quite light structure features the shape of a hollow circular cylinder having an axially extending inner chamber 12 with an inner circumferential wall 13 and two end surface portions 14 and 15. See hereto FIG. 3.

The transition portion 16 between the end surface portion 14 and the inner circumferential wall 13 of the inner chamber 12 features the geometrical shape of the jacket of a truncated cone. The transition portion 17 extending between the end surface portion 15 and the inner circumferential wall 13 of the inner chamber 12 features in the same manner the geometrical shape of the jacket of a truncated cone.

The ends of the shaft portions 8, 9 which face each other include also a portion 18 and 19, resp. in the geometrical shape of the jacket of a truncated cone.

It can be seen clearly, therefore, that after the threaded tightening bolt 11 has been tightened, the respective portions 16, 18 and 17, 19 which have the geometric shape of a truncated cone abut each other so that the upper feeding roller 10 located between these shaft portions is firmly held in a clamped and guided state.

As also can be seen clearly, when the upper feeding roller 10 is to be dismounted it is merely necessary to loosen and unscrew the threaded tightening bolt 11 and to pull it a little out through an opening in the frame 1, through which opening the threaded tightening bolt 11 is accessible. Thereafter, the feeding roller can be dismounted and removed without any further ado.

Figure 3:
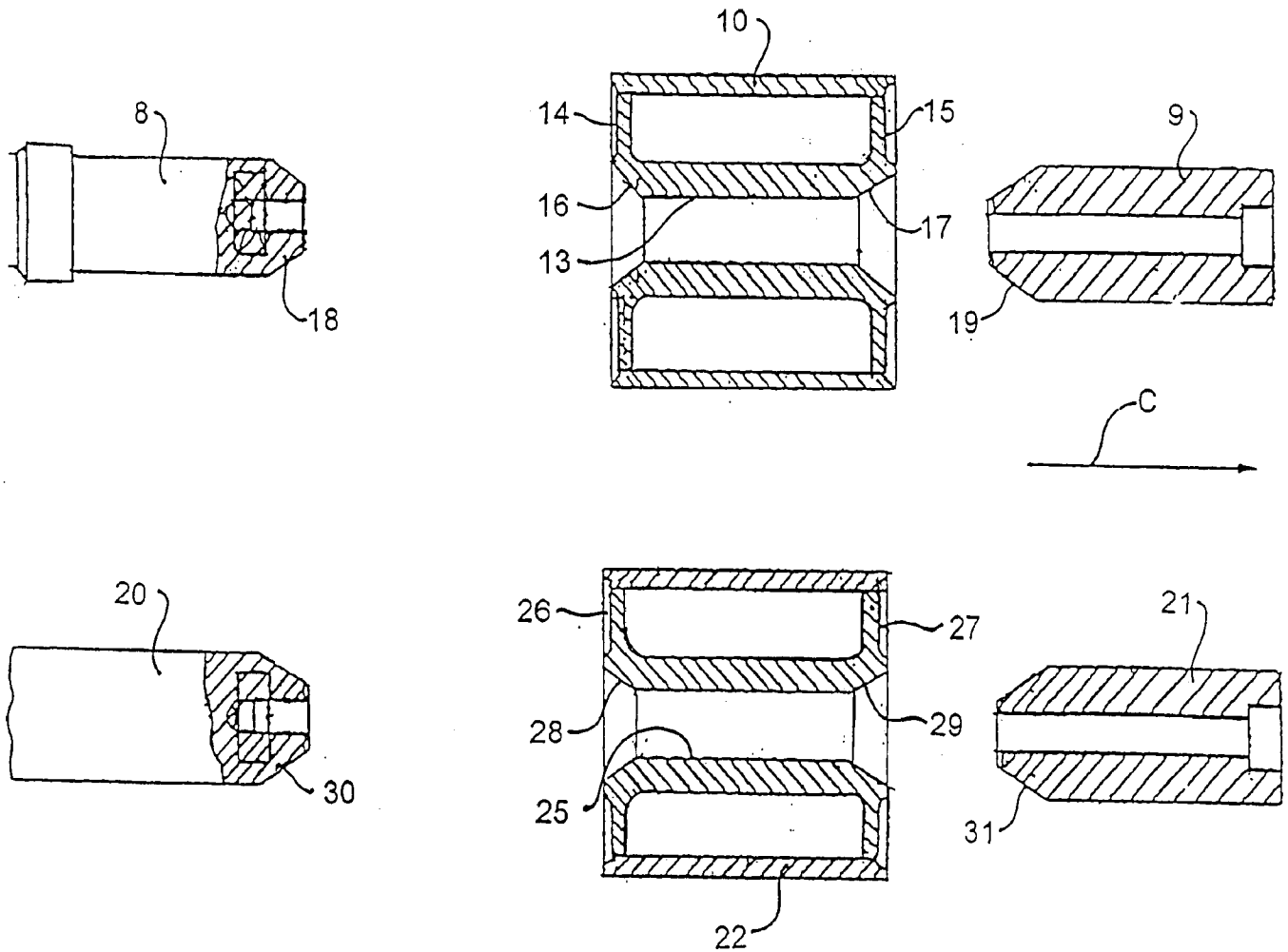
FIG. 3 illustrates the first and second section of the upper shaft structure and the lower shaft structure, including the upper and the lower feeding roller, shown in a axially exploded view.

This state is illustrated on a purely exemplary basis in connection with the still to be described lower shaft portions 20, 21 and the lower feeding roller 22 in FIG. 3. The illustrated axial distances, which will be entered into further below are designed in a exaggerated manner.

The lower shaft assembly 20, 21 is also composed of a first shaft portion 20 located axially adjacent the electric servomotor 2 and of a second shaft portion 21 located axially at a distance from the first shaft portion 20 and remote from the electric servomotor 2. The lower feeding roller 22 is held between these two shaft portions 20, 21 in a clamped state.

A threaded tightening bolt 23 extends axially through the second shaft portion 21 located remote from the electric servomotor 2, which threaded tightening bolt 23 rests against the second shaft portion 21 and is threadingly engaged in the first shaft portion 20 located adjacent the electric servomotor 2.

The two shaft portions 20, 21 are held tightened against each other by this threaded tightening bolt 23, so that the lower feeding roller 22 which is located between these shaft portions 20, 21 is firmly held in a clamped state.

This lower feeding roller 22 which consists of several parts and is of a quite light structure features the shape of a hollow circular cylinder having a axially extending inner chamber 24 with a inner circumferential wall 25 and two end surface portions 26 and 27.

The transition portion 28 extending between the end surface portion 26 and the inner circumferential wall 25 of the inner chamber 24 features the geometrical shape of the jacket of a truncated cone. The transition portion 29 extending between the end surface portion 27 and the inner circumferential wall 25 of the inner chamber 24 features in the same manner the geometrical shape of the jacket of a truncated cone.

The ends of the shaft portions 20, 21 which face each other include also a portion 30 and 31, resp. in the geometrical shape of the jacket of a truncated cone.

It can be seen clearly, therefore, that after the threaded tightening bolt 23 has been tightened, the respective portions 28, 30 and 29, 31 which have the geometrical shape of a truncated cone abut each other so that the lower feeding roller 22 located between these shaft portions is firmly held in a clamped and guided state.

As also can be seen clearly is that if the lower feeding roller 22 is to be dismounted it is merely necessary to loosen and unscrew the threaded tightening bolt 23 and to pull it out through an opening in the frame 1, through which opening the threaded tightening bolt 23 is accessible.

Thereafter, the feeding roller 22 can be dismounted and removed without any further ado.

This state is illustrated in FIG. 3.

Figure 2:
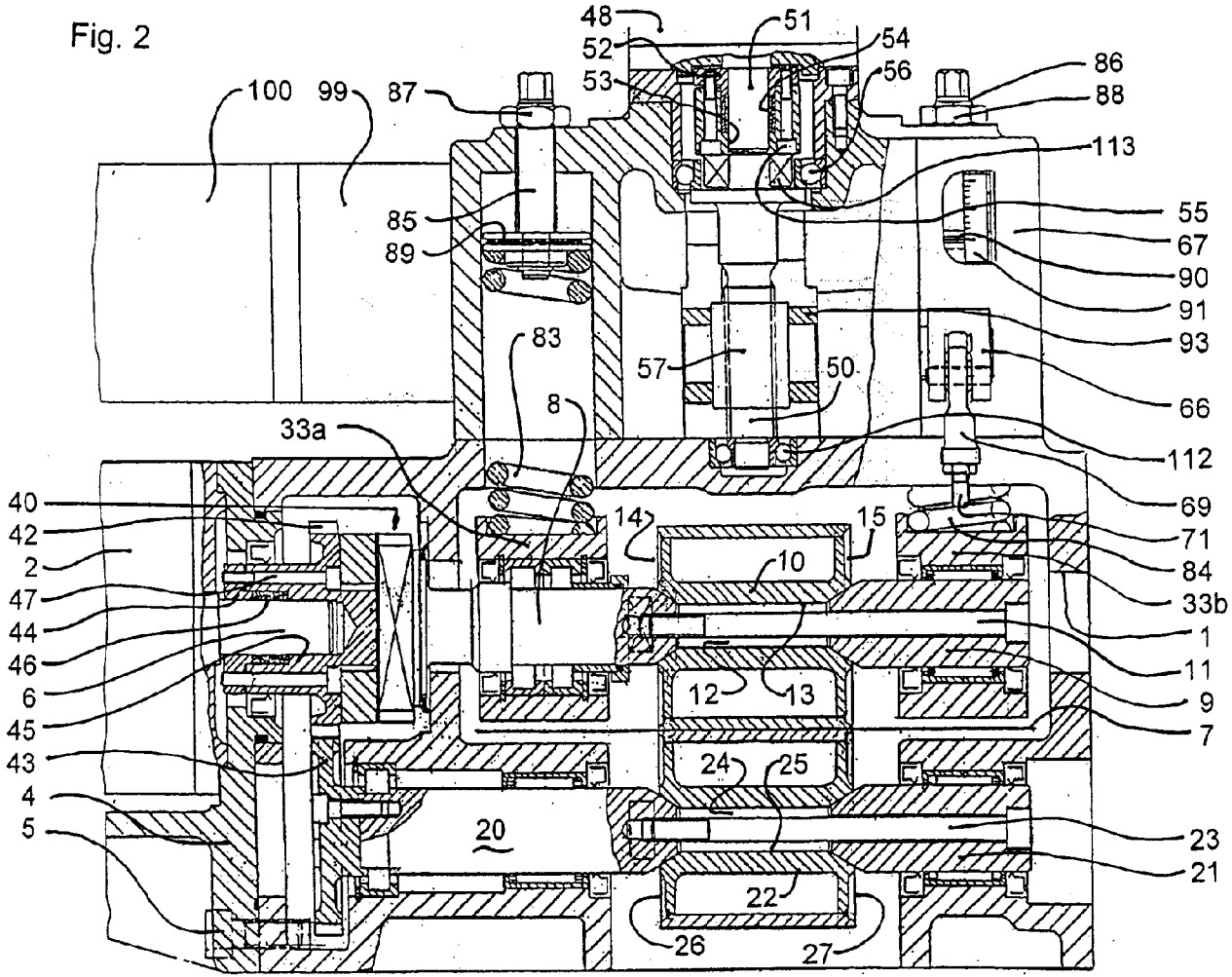
FIG. 2 illustrates a portion of FIG. 1, drawn on a enlarged scale.

The first shaft portion 8 of the upper shaft assembly which shaft portion 8 is located adjacent the electric servomotor 2 and the first shaft portion 20 of the lower shaft assembly which shaft portion 20 is located adjacent the electric servomotor 2 remain stationary, such as e.g. illustrated in FIG. 2. Thus, they are not displaced. The second shaft portion 9 of the upper shaft assembly which shaft portion 9 is located remote from the electric servomotor 2 and the second shaft portion 21 of the lower shaft assembly which shaft portion is located remote from the electric servomotor 2 have been, after the threaded tightening bolts have been loosened, displaced axially in the direction of the arrow C. Accordingly, the feeding rollers 10, 22 lie exposed and can be removed from the shafts. It is to be noted that the axial distances between the structural members illustrated in FIG. 3 are shown exaggerated. The free space between the respective shaft portions, i.e. the distance between these shaft portions must be only that large that the feeding rollers, in order to remove them, can be displaced freely in the radial direction.

Figures 7, 7A, 7B:
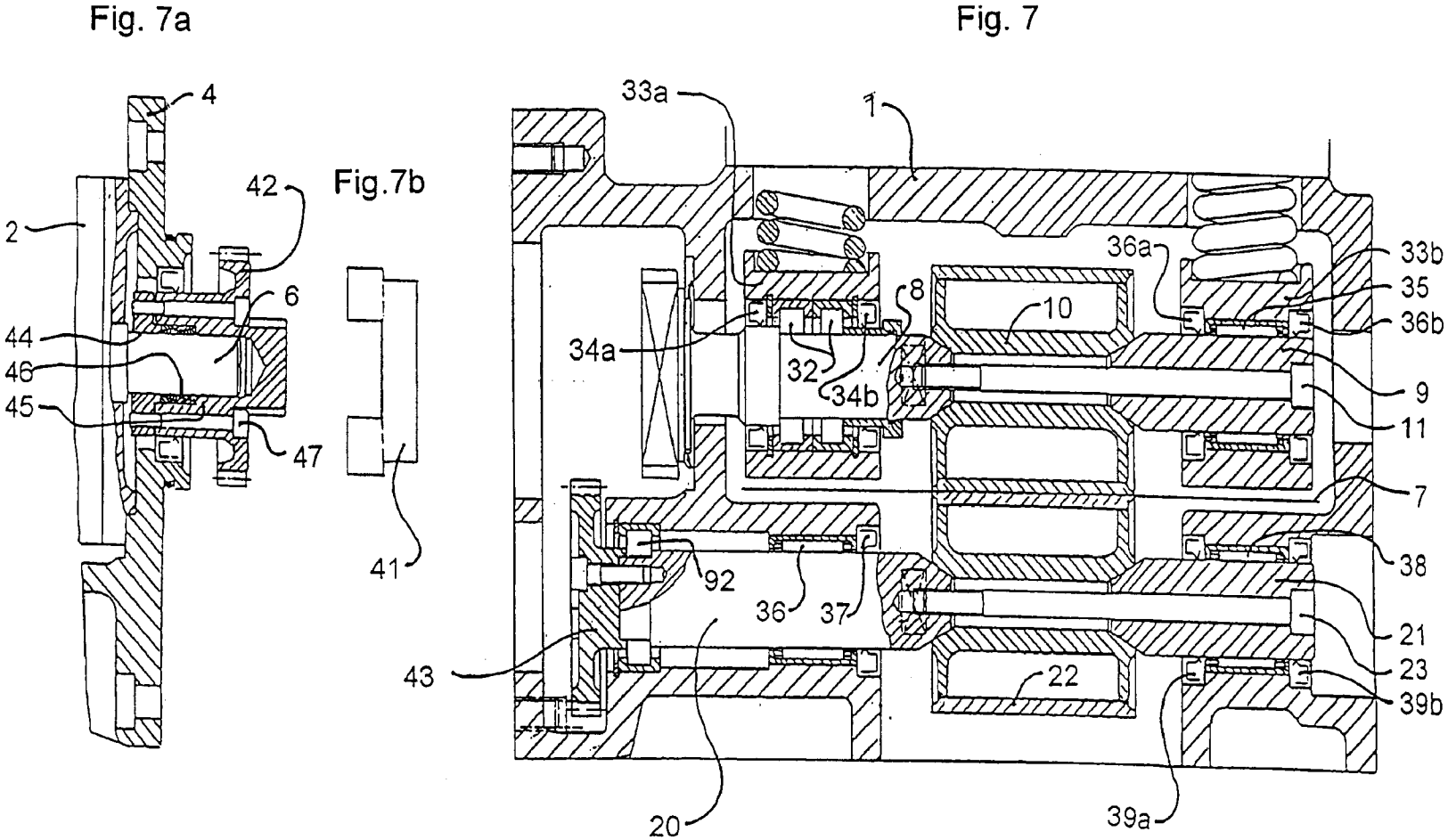
FIG. 7 is a section through a part of the apparatus, in a state in which the electric servomotor with the driving gear wheel and the cross-type disc of the Oldham-type coupling are demounted.
FIG. 7*a* illustrates the flange of the electric servomotor with the driving gear wheel in the mounted state, and a part of the Oldham-type coupling.
FIG. 7*b* illustrates the cross-type disc of the Oldham-type coupling.

Reference is now made to FIG. 7. The first shaft portion 8 of the upper shaft assembly which shaft portion 8 is located axially adjacent the electric servomotor 2 is supported through a roller bearing 32 in a rocker 33 still to be described, i.e. in the rocker portion 33*b*. The chamber of the lubricant of the roller bearing 32 is sealed off by seals 34*a*, 34*b*.

The second shaft portion 9 of the upper shaft assembly which shaft portion 9 is located remote from the electric servomotor 2 is supported through roller bearings 35 in the rocker portion 33*b*. The chamber of the lubricant of the roller bearing 35 is sealed off by seals 36*a*, 36*b*.

The first shaft portion 20 of the lower shaft assembly which shaft portion 20 is located adjacent the electric servomotor 2 is supported by roller bearings 36 and 92 in frame 1. The chamber of the lubricant of the roller bearing 36 is sealed off by a seal 37.

The second shaft portion 21 of the lower shaft assembly which shaft portion 21 is located remote from the electric servomotor 2 is supported in the frame 1 by roller bearings 38 and 92. The chamber of the lubricant of the roller bearing 38 is sealed of by seals 39*a*, 39*b*.

Accordingly, it can be seen that each bearing of the shaft portions 8, 9, 20, 21 is located in its own lubricant chamber and accordingly that the dismounting of the feeding rollers 10, 22 can be accomplished without any opening of lubricant chambers. Accordingly, the respective exchanging of the feeding rollers 10, 22 can be done in a quite simple manner.

According to a first preferred embodiment the upper shaft assembly supported in the rocker 33, i.e. more precisely the first shaft portion 8 of the upper shaft structure located axially adjacent the electric servomotor 2 supported in the rocker portion 33*a* is drivingly connected to the first electric servomotor 2.

The first shaft portion 8 is connected to a Oldham-type coupling 40 of which the cross-type disc 41 is illustrated separately in FIG. 7*b*. This Oldham-type coupling 40 is necessary because the first shaft portion 8 (and obviously all parts of the apparatus which are connected to the fist shaft portion) performs lateral movements relative to the as such stationary (except of course the rotating) drive shaft 6 of the electric servomotor 2.

This Oldham-type coupling 40 is followed by a upper spur gear 42 which meshes with a lower spur gear 43, which in turn is connected to the first shaft portion 20 of the lower shaft assembly located adjacent the servomotor 2.

The coupling of the upper spur gear 42 to the drive shaft 6 of the electric servomotor 2 is accomplished by a multi-part clamping sleeve device with a first clamping sleeve part 44 and a second clamping sleeve part 45.

The co-acting of the clamping sleeve parts 44 and 45 is performed by annular clamping elements 46. The clamping sleeve screw bolts are identified by the reference numeral 47.

The upper spur gear 42 is made integral with the second clamping sleeve part 45, so that a considerable saving on moving masses is achieved.

According to a preferred embodiment a portion of the Oldham-type coupling is also made integral with the second clamping sleeve part 45.

According to a further preferred embodiment no spur gears are present, so that the lower feeding roller 22 is rotated exclusively by a frictional engagement with the metal strip 7.

Figure 8:
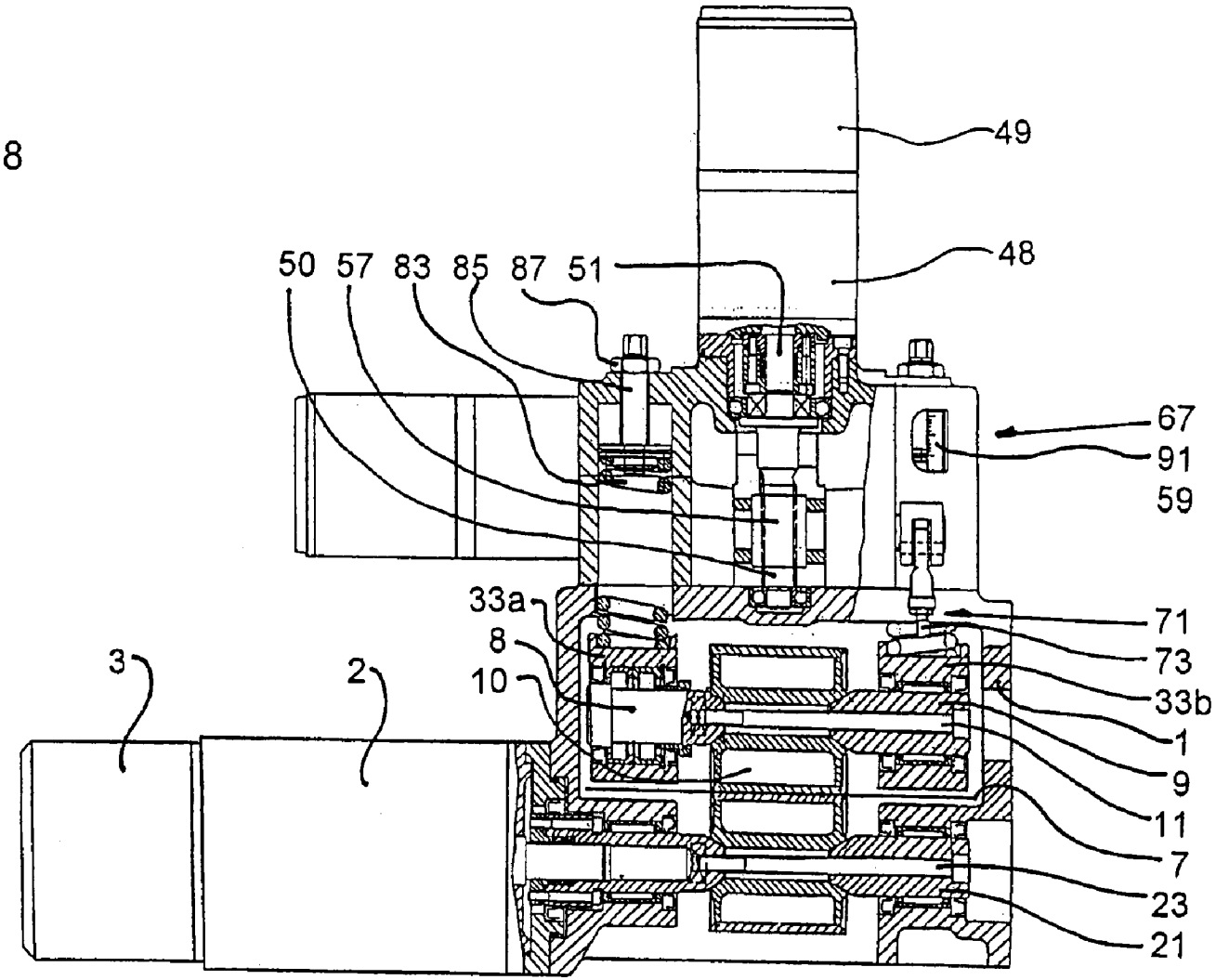
FIG. 8 is a section through a further embodiment of the apparatus according to the present invention.
Figure 9:
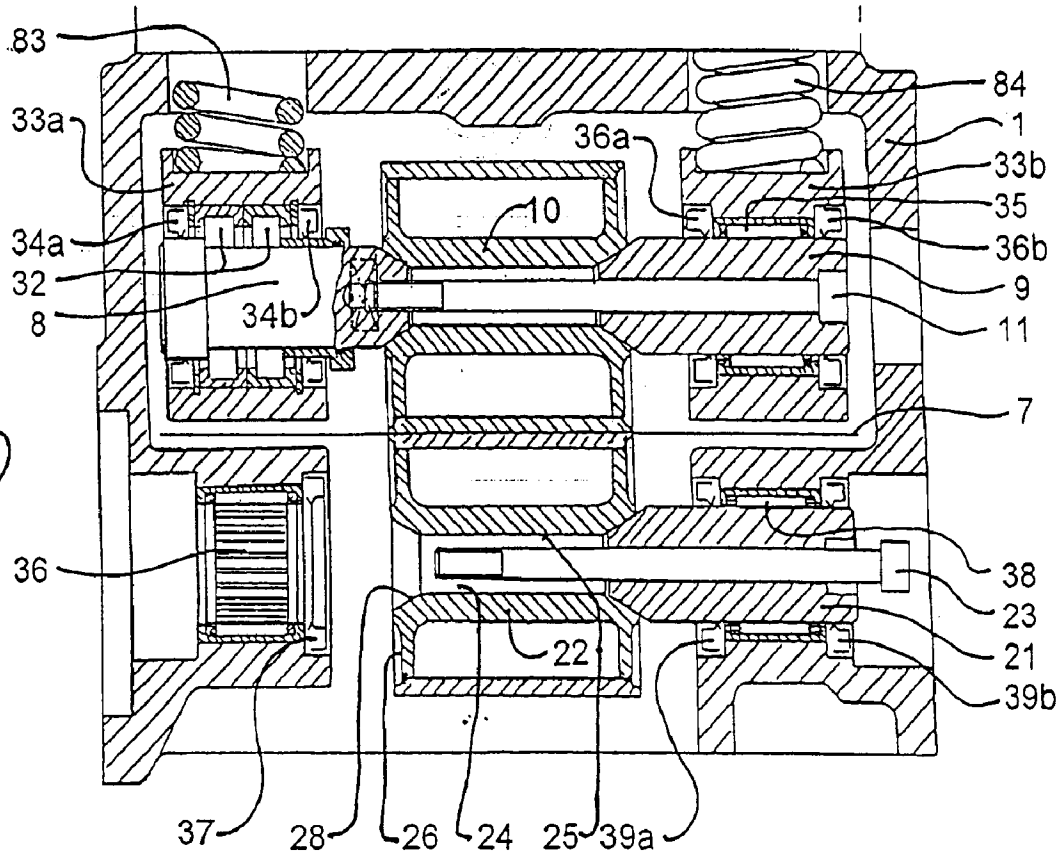
FIG. 9 is a section through a part of the apparatus illustrated in FIG. 8, in which the drive for the lower roller is demounted.
Figure 9A:
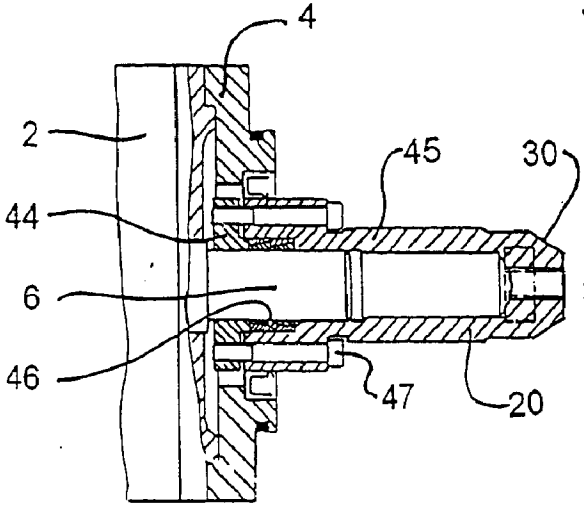

A still further embodiment is illustrated in FIGS. 8, 9, 9*a*. According to this embodiment the upper feeding roller 10 is rotated by a frictional engagement with the metal strip.

In this embodiment the first shaft portion 20 of the lower shaft assembly is driven by the electric servomotor 2. This shaft portion 20 is, thereby, made integral with the second clamping sleeve part 45, so that again a minimal rotating mass is present.

A further electric servomotor 48 is located on top of a threaded spindle housing 67 of the feeding apparatus. Its electronic control, i.e. the housing thereof, is identified by the reference numeral 49.

This electric servomotor 48 serves for the driving of a threaded spindle 50.

The electric servomotor 48 is to be considered merely as a example of the drive for the threaded spindle 50. It is also possible to have drives different from the servomotor 48.

The drive shaft of the electric servomotor 48 is identified by the reference numeral 51. The connection between the drive shaft 51 of the electric servomotor 48 and the threaded spindle 50 is accomplished by a multi-part clamping sleeve device which includes a first clamping sleeve part 53 and annular clamping elements 54. The clamping sleeve parts 52, 53 are tightened against each other by clamping screw bolts 55.

The second clamping sleeve part 53 is coupled to the threaded spindle 50 through a jaw clutch coupling 113. The threaded spindle 50 is in turn supported in the threaded spindle housing 67 or housing 1, respectively, through roller bearings 56 and 112.

Accordingly, the threaded spindle 50 is supported free from play independent from the servomotor 48.

Because annular clamping elements are used for connection to the smooth shaft of the servomotor, a standard servomotor, thus no custom made design an be used.

A adjusting nut 57 is arranged on the threaded spindle 50.

A double arm lever 93 with a first arm 94 and a second arm 95 is supported on this adjusting nut. This arm 93 is termed in this specification second double arm lever 93.

Figure 4:
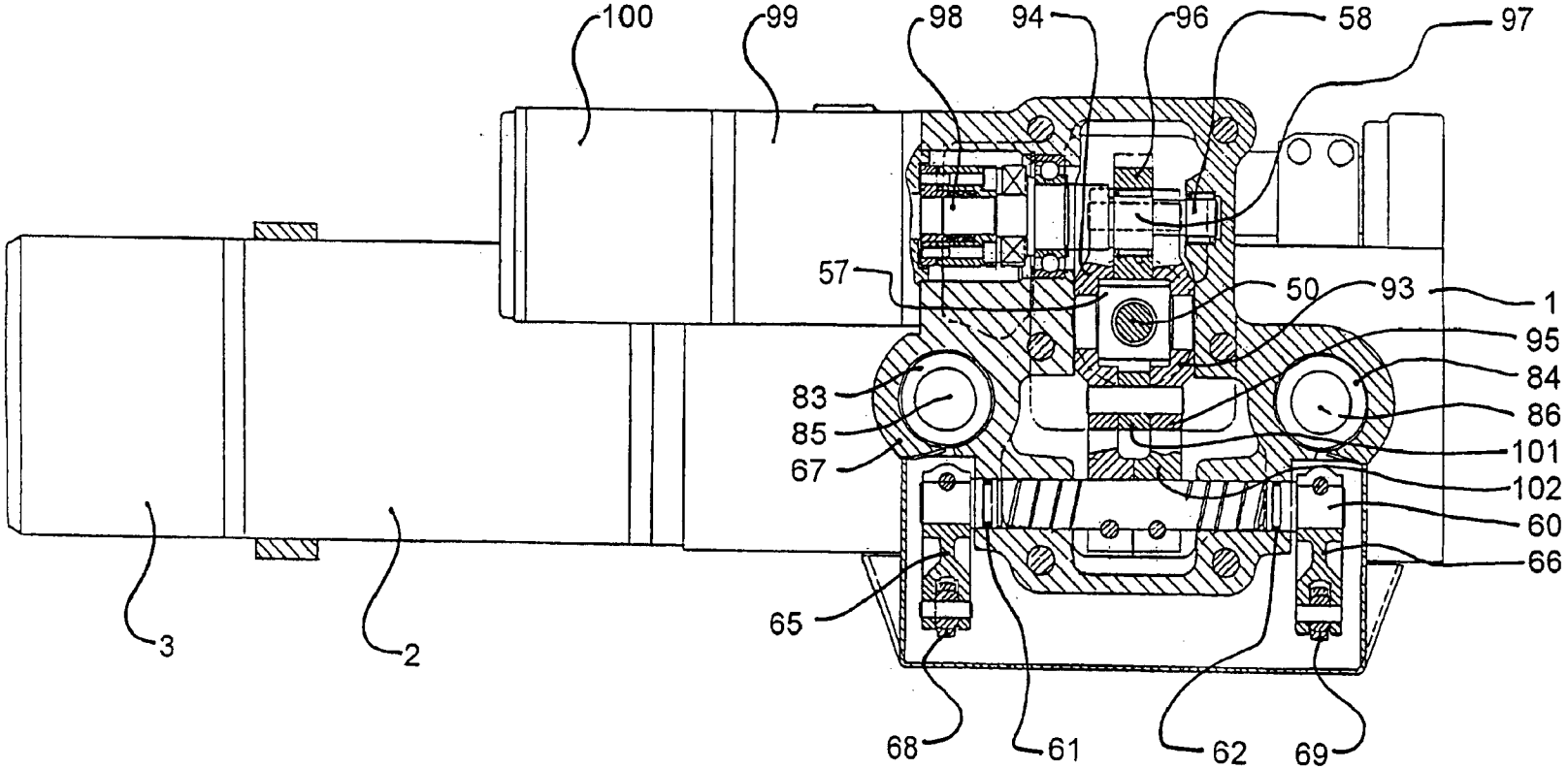
FIG. 4 is a section along line IV—IV of FIG. 1.

As clearly can be seen in FIG. 4, the adjusting nut has a square cross-sectional shape and is set into a inner space of the first double arm lever 93 which features also a square cross-sectional shape. Accordingly, the adjusting nut is secured against a rotating.

A bolt 58 is set into a first arm 94 of the first double arm lever 93. The bolt 58 extends through a elongate hole 59 in a rod 96.

The rod 96 sits on a an eccentric disc 97 which is drivingly connected to a third driving motor 99, for instance a electric servomotor. The control of the servomotor is identified by the reference numeral 100.

The second arm 95 of the first double arm lever 93 is pivotally mounted to a first arm 102 of a second double arm lever 103 through a strap 101. The second double arm lever 103 is supported on a shaft 60. The second arm 104 of the second double arm lever 103 is of a forked design, such as illustrated in FIG. 4 by the reference numerals 65, 66 designating the fork levers. The shaft 60 is sealed in the threaded spindle housing 67 oil-tight by seals 61, 62, so that a closed threaded spindle housing 67 as a closed lubrication oil chamber is present, in which the threaded spindle 50 and the above described structure members are located in a maintenance-free manner.

Specifically FIG. 4 illustrates that the shaft 60 projects at both its ends out of the threaded spindle housing 67 and that the forked lever arms 65, 66 are clamped onto these projecting ends.

These forked lever arms 66, 66 are pivotally mounted through a ball end connection to an upper shaft portion 68 and 69, resp. of a control rod generally identified by 70 and 71, resp., which upper shaft portions are threadingly engaged with lower shaft portions 72 and 73, resp. The described shaft positions are secured against a rotation by both nuts 74 and 75, respectively.

The control rods 70 and 71 are pivotally mounted at their lower ends to the rocker 33.

Figure 5:
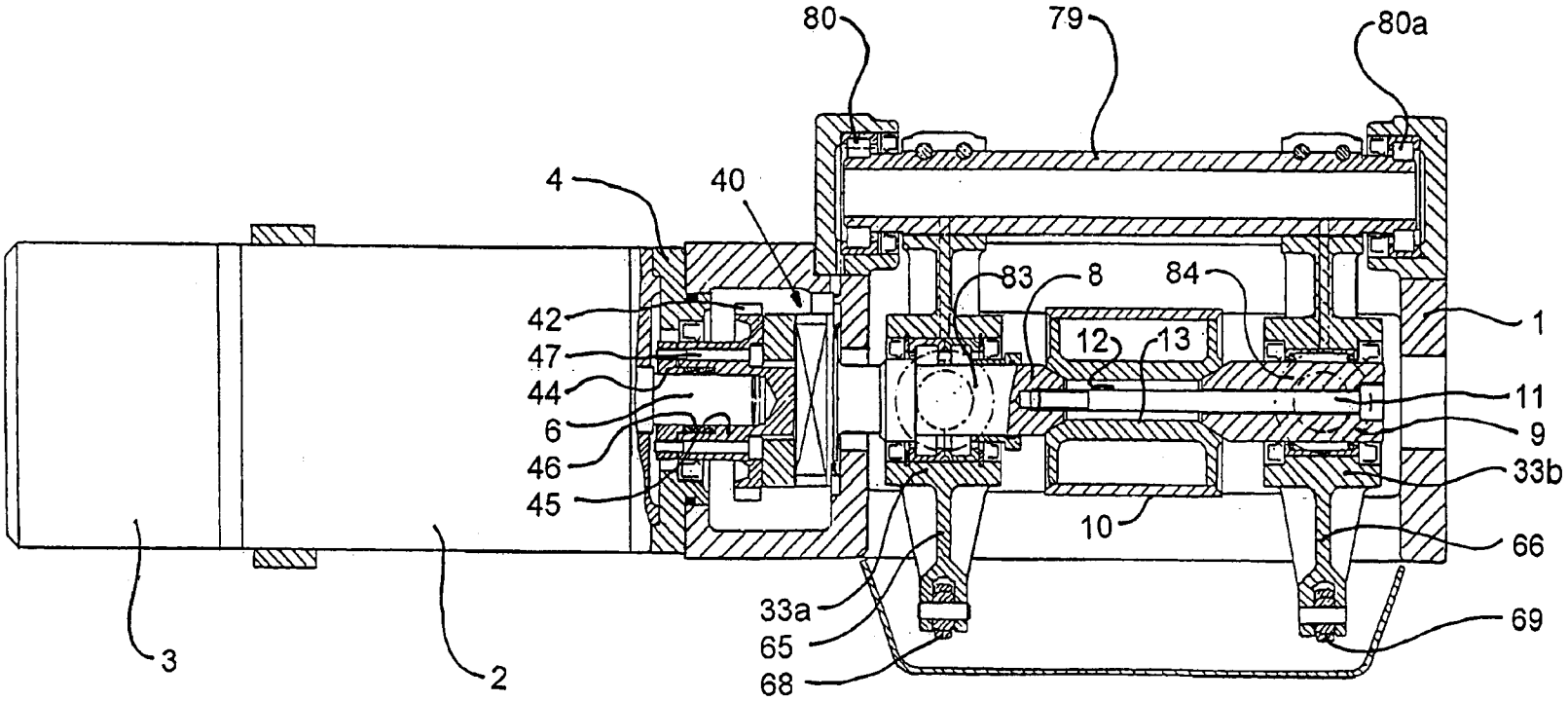
FIG. 5 is a section along line V—V of FIG. 1.

The rocker 33, in which the upper feeding roller 10 is supported, is mounted at its end opposite the control rods 70 and 71, resp. to a shaft 79. This shaft 79 is supported in the frame 1. The bearings 80, 80*a* of the shaft 79 are shown in FIGS. 5.

Thus, it can be seen that the rocker 33 inclusive the upper feeding roller 10 supported in the rocker can perform rocking, that is pivoting movements around the shaft 79. Accordingly, the upper feeding roller 10 can be moved against the lower feeding roller 22 and the metal strip 7 fed in the direction of the arrow B resting thereupon, and again away from the lower feeding roller 22.

Figure 6:
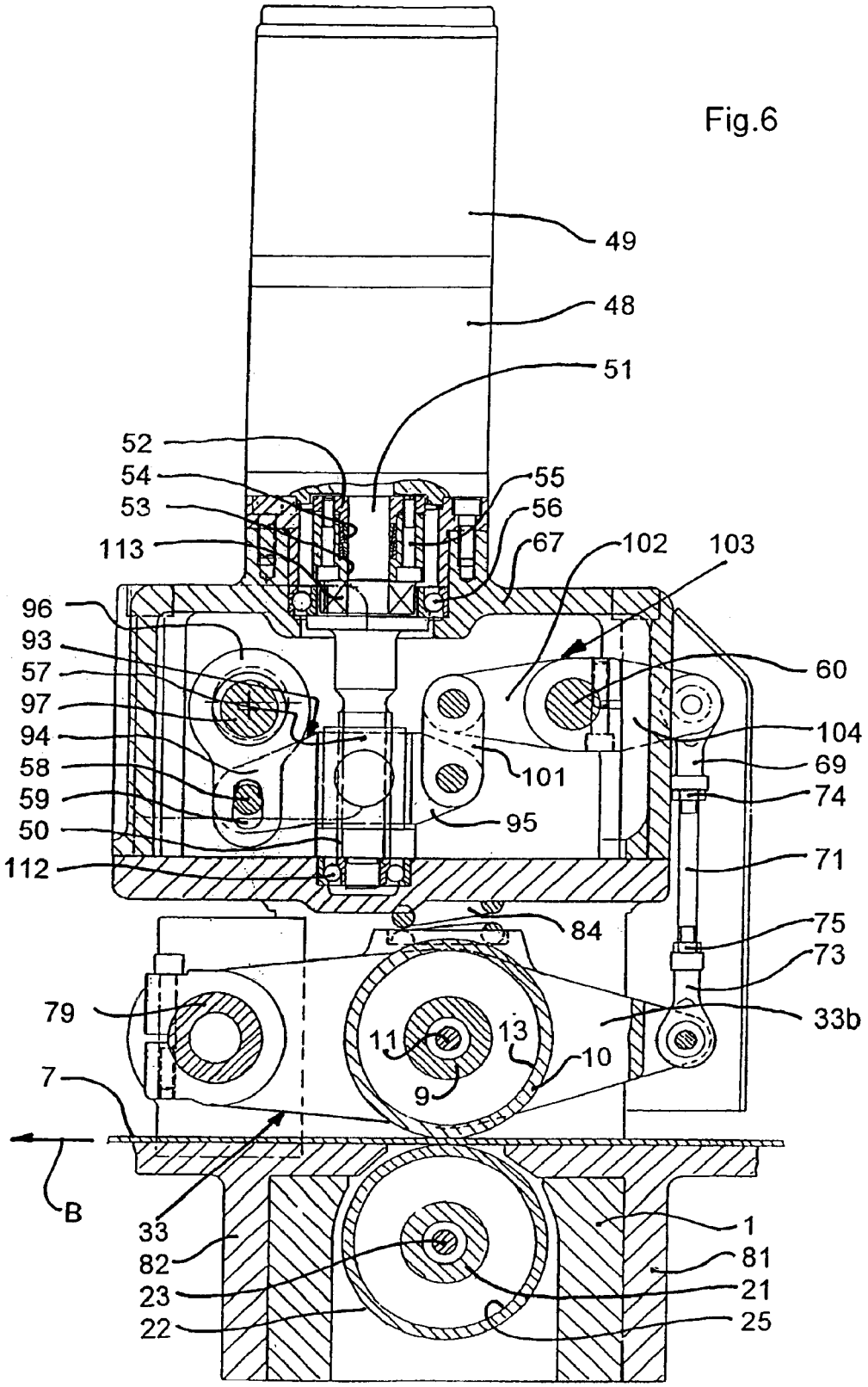
FIG. 6 is a section along line VI—VI of FIG. 1.

The strip entering table 81 and the strip exiting table 82, well known in the art, are additionally shown in FIG. 6, whereby the metal strip 7 lies at both sides of the lower feeding roller 22 on these two tables 81, 82.

The rocker 33 is biased by pressure springs 83 and 84, resp. against the lower feeding roller 22.

The biasing force of the pressure springs 83, 84 is adjusted by threaded spindles 85, 86 and locking nuts 87, 88 which rest against the threaded spindle housing 67.

The adjusting of the pressing on force proceeds by a reading of the position of discs, 89, 90 relative to a scale 91, which discs rest on the pressure springs 83, 84.

Obviously, a scale is allocated to each pressure spring 83, 84.

The described feeding apparatus is adapted to feed a strip shaped blank 7, e.g. a metal strip 7, to a press which is equipped with tools for an intermittent working of the strip shaped blank 7.

Figure 13:
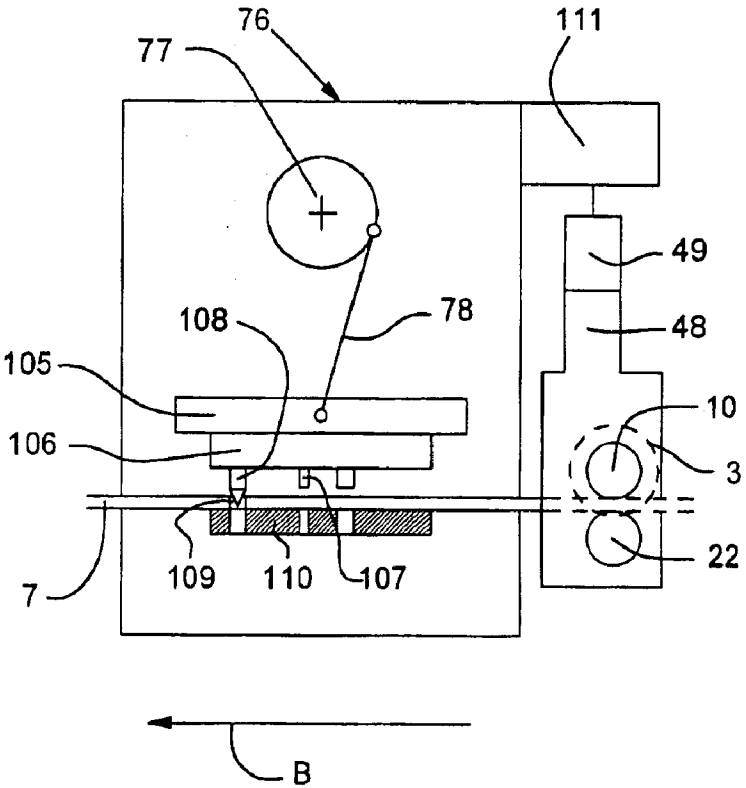
FIG. 13 illustrates schematically a punch press cooperating with a feeding apparatus according to the present invention.
Figure 12:
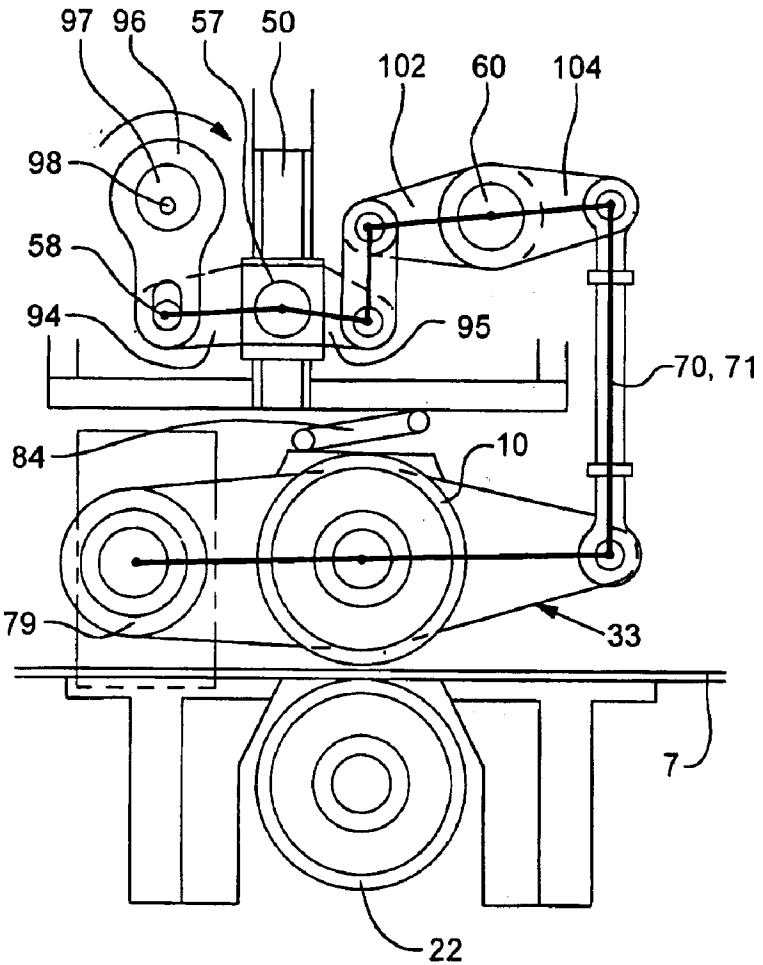
FIG. 12 depicts the illustration of FIG. 6 in a simplified manner, whereby the feeding apparatus is illustrated in the state of the intermediate lift.

This feeding apparatus and the press 76, a punch press, allocated to the feeding apparatus are illustrated schematically in FIG. 13.

The punch press 76 includes a drive 77. Such as known to the person skilled in the art, this drive 77 can include a electromotor which drives a crank shaft or a shaft with eccentric discs. This crank shaft or eccentric disc is drivingly connected to a rod 78. A punch 105 is pivotally mounted to this rod 78. The punch 105 supports a upper tool 106, which conclusively is moved upwards and downwards when the punch press 76 is in operation. The upper tool 106 is equipped with working tools, e.g. punches 107. The upper tool 107 is, furthermore, equipped with positioning pins 108, each having a conical head portion 109.

In operation, such as is generally known, prior to the impacting of the working tools, thus e.g. punches 107 onto the strip shaped blank 7 for the working or processing proper, the positioning pins 108 are moved into pre-punched holes in the blank 7 in order to precisely center same. The upper feeding roller 10 is, thereby, lifted off the lower feeding roller 22 during a short time span by a short distance, so that no clamping force is exerted onto the blank 7. This position of the upper feeding roller 10 is called intermediate lift.

Furthermore, the stationary lower tool 110 and the control apparatus 111 of the punch press 70 are illustrated in FIG. 13.

As can be seen, the control apparatuses 49, 110 of the feeding apparatus and of the punch press 76 communicate, because the operation of the feeding apparatus must be coordinated with the operation of the punch 76.

Figure 10:
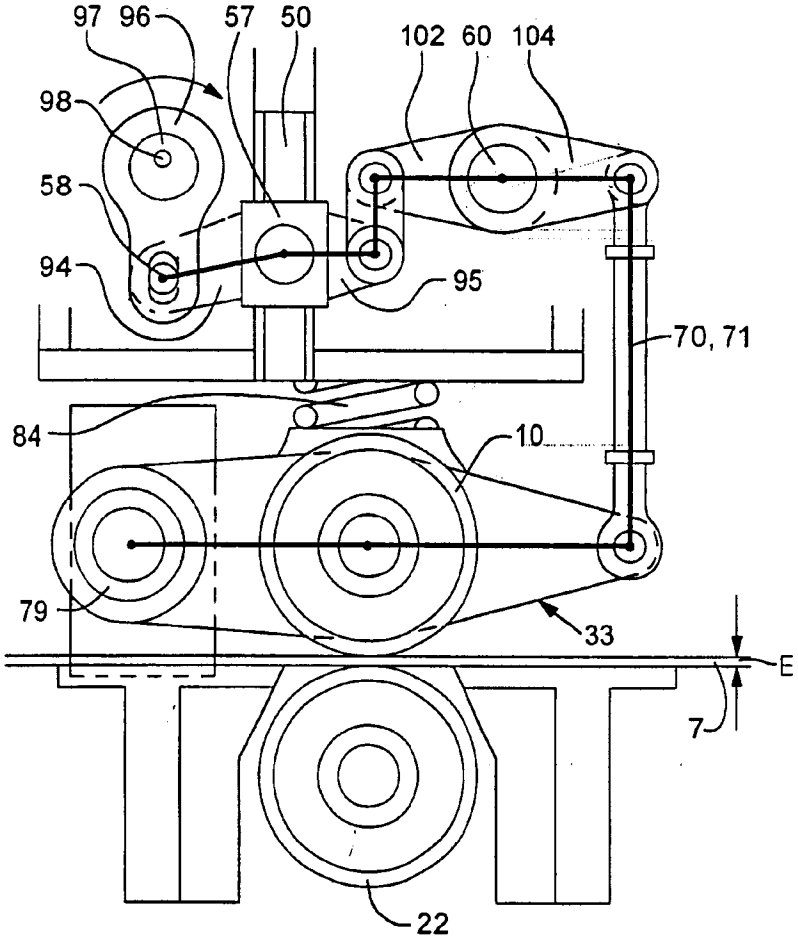
FIG. 10 depicts the illustration of FIG. 6 in a simplified manner, whereby the feeding apparatus is illustrated in the state of continuous operations without any intermediate lift.

FIG. 10 illustrates the positions of the schematically designed parts of the feedings apparatus during a continuous operation phase. During the continuous phase operation the upper feeding roller 10 and the lower feeding roller 22, are both driven by the electric servomotor 2 in a intermittent fashion, so that the blank 7, such as generally known, is fed step by step. The (electronic) control apparatus 49 of the feeding apparatus cooperates, thereby, with the (electronic) control apparatus 111 of a punch press 76. See hereto FIG. 13. The punch press 76 comprises a moveable upper tool 106 and a stationary lower tool 110. The upper tool 106 is mounted to a punch 105. The punch 105 is driven by a rotating drive 77, e.g. a electric motor and crank shaft or eccentric shaft through a rod 78, whereby the rod 78 represents purely schematically the drive connection between the drive 77 and the punch 105.

Thus, the punch is moveable between a top dead center position and a lower dead center position.

The dimension of the thickness of the strip shaped blank 7 and correspondingly the distance between the upper feeding roller 10 and the lower feeding roller 22 is represented in FIG. 10 by the letter E.

Figure 11:
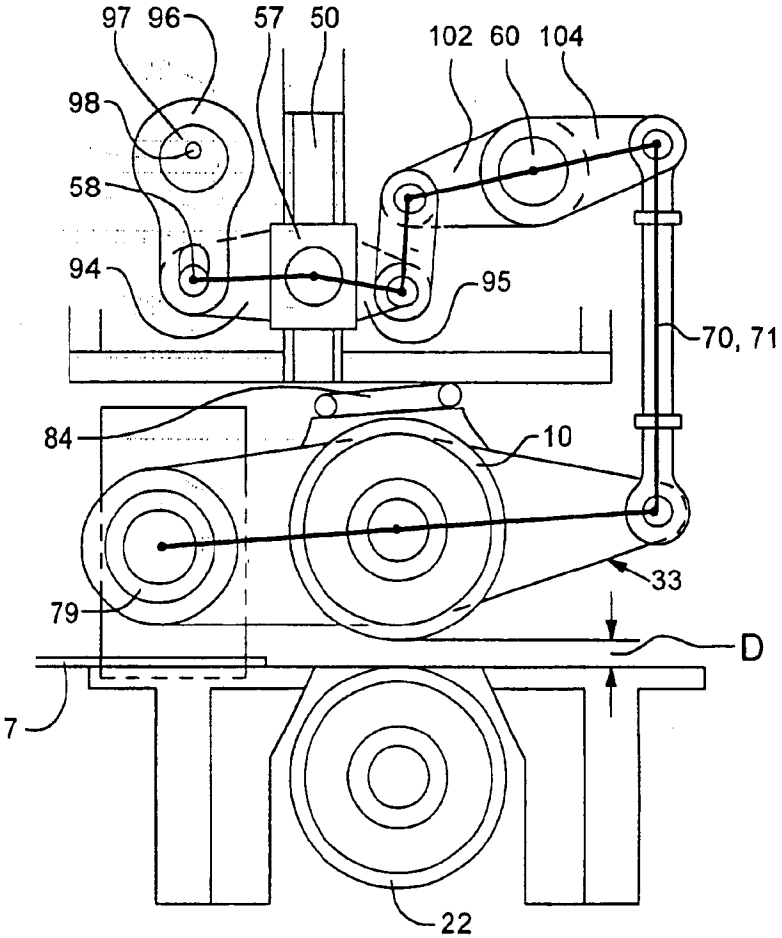
FIG. 11 depicts the illustration of FIG. 6 in a simplified manner, whereby the feeding apparatus is illustrated in the state of the high lift position.

In order to be able to insert a fresh strip-like blank 7, thus for instance a metal strip between the upper feeding roller 10 and the lower feeding roller 22, the upper feeding roller 10 must be lifted off so that it is at a set distance D from the lower feeding roller 22, which is larger than the distance E. This distance D and the lifted off position of the upper feeding roller 10 are illustrated in FIG. 11.

In the art, this position of the feeding roller 10 is called high lift position.

In order to set this high lift position the control apparatuses 49 and 111 of the feeding apparatus and of the punch press 76 are controlled in such a manner, that the punch 105 of the punch press is located remote from the lower dead center position and the rod 96 is located remote from the top dead center position. In which specific positions the punch 105 and rod 96 are located is not of importance as long as the punch is not located at the lower dead canter position. Generally, and this is known by the person skilled in the art, the control apparatuses 49 and 111 of the feeding apparatus and the punch press are operated in such a manner, that the punch 105 of the punch press is located at the top dead center position and the rod 96 is located at the lower dead center position. The now following description proceeds from these latter dead center positions. When said dead center positions are arrived at, the adjusting nut 57 is lowered by a corresponding rotating of the threaded spindle 50.

Due to the pressure springs 82, 84 above the rocker 33 and the lever units 93 and 103 the bolt 58 abuts the lower end of the elongate hole 59.

Due to the downwards movement of the adjusting nut 57 the first arm 94 of the first double arm lever unit 93 is pivoted upwards and its second arm 95 is pivoted downwards. This second arm 95 pulls the first arm 102 of the second double arm lever device 103 also downwards. Accordingly, the second arm 104 of the second double arm unit 103 is pivoted upwards. Conclusively, the control rod assembly 68-75 is lifted and accordingly the rocker 33 with the upper feeding roller supported therein is pivoted into the high lift position of the upper feeding roller 10, in which position it has mentioned distance D from the lower feeding roller 22, so that a fresh strip shaped blank 7 may be inserted.

For the continuous operation the upper feeding roller 10 must lie on the strip shaped blank 7, whereby a clamping force for a frictional engagement of the strip-like blank must be exerted by the upper feeding roller 10 and the lower feeding roller 22.

The clamping force is produced by pressure springs 83, 84.Thus, the bolt 58 is no longer to abut the lower end of the elongate hole 59. To this end, the adjusting nut 57 is lowered from the high lift position by a rotating of the threaded spindle 50, until the upper feeding roller 10 lies on the strip shaped blank 7.

Due to the continued lowering movement of the adjusting nut 57 the first double arm lever 93 is forced to perform a pivoting movement, because the rocker does no longer move because the upper feeding roller 10 is kept to lie on the strip-shaped blank by the pressure springs 83, 84. Mentioned pivoting movement causes an upwards pivoting of the first arm 94 with the bolt 58, 50 that the bolt 58 is located in the elongate hole 59 between its ends. This means, that the rod 96 can basically perform stroke movements without a action onto the bolt 58.

A further movement during operation of the feeding apparatus with the punch press is the intermediate lifting.

It has been mentioned above that a upper tool 106 of a punch press can be equipped with positioning pins 108 for a precise positioning of the strip-shaped blank 7.

In order to allow such a positioning, it is necessary that the strip-like blank must lie unencumbered during a short time span. This means that the upper feeding roller 10 must be lifted off the strip-shaped blank 7 for a short time span into a intermediate lift position.

This intermediate lift position is produced by the rod 96.

Firstly, the punch press 76 is operated into the stroke position, in which the intermediate lift position shall occur and in which the conical head portions 109 of the positioning pins 108 are inserted partly into the positioning hole. This position is illustrated in FIG. 13.

In this position the punch 105 of the punch press 76 is located at a angular position ahead of the bottom dead center position. Accordingly, a angular distance between mentioned angular position and the bottom dead center position is present.

The rod 96 of the feeding apparatus has now been simultaneously moved upwards by operation of its drive motor 99 into a position ahead of its top dead center position. Accordingly, there also exists a angular distance between this angular position and the top dead center position.

The angular distance mentioned in connection with the punch press is the same angular distance as present at the feeding apparatus.

Now, the adjusting nut 571 is moved downwards by a rotating of the threaded spindle 50. Accordingly, the bolt 58 comes to rest on the lower end of the elongate hole 59. Then, the adjusting nut 57 is moved still further downwards, 50 that due to the now following pivoting movements of the lever units and of the rocker 33 the upper feeding roller 10 releases the strip-shaped blank. In this released state the strip-shaped blank is loose to such e an extent that it can be moved manually. This position of the adjusting nut 57 is stored together with the corresponding angular positions in the control apparatuses 49 and 111.

This means, that during the continuous operation the rod 96 with its elongate hole 59 can freely move relative to the bolt 58 without influencing the bolt, with the exception that if the rod 96 reaches the above mentioned angular position ahead of the top dead center position of the rod 96, the lower end of the elongate hole 59 engages the bolt 58, lifts it up and after the top dead center position has been passed, the bolt 58 is again released.

While there are shown and described presently preferred embodiments of the invention, it is to be distinctly understood that the invention is not limited thereto but may be otherwise variously embodied and practiced within the scope of the following claims.

What is claimed is:

1. An apparatus for an intermittent feeding of a strip shaped blank to a punch press which is equipped with tools adapted for intermittent working of the strip shaped blank, which feeding apparatus includes a housing and a threaded spindle housing arranged on said housing, an upper shaft assembly and an upper feeding roller mounted on said upper shaft assembly, a lower shaft assembly and a lower feeding roller mounted on said lower shaft assembly, which feeding rollers are adapted to grip said blank to be fed by clamping said blank at both its sides and to feed said blank intermittently by an intermittent rotational movement, of which shaft assemblies at least one is drivingly connected to an intermittently operating electric servomotor and the upper shaft assembly is supported in a rocker which is pivotally mounted at said housing through a rocker shaft, by means of which rocker said upper shaft assembly is movable towards and away from said lower shaft assembly; comprising an adjusting motor with a threaded spindle and a control apparatus, an adjusting nut arranged on said threaded spindle and adapted to be moved along said spindle by a rotational movement of said spindle; a drive motor and an eccentric disc drivingly coupled to said drive motor, a rod supported on said eccentric disc, which rod has at an end remote from said eccentric disc an elongate hole extending at least approximately parallel to said threaded spindle; a first double arm lever unit supported on said adjusting nut and a second double arm lever unit supported on a shaft which in turn is supported in said threaded spindle housing; which first double arm lever unit includes a first arm which engages said rod and includes a second arm which is pivotally mounted to a connecting strip which in turn is pivotally mounted to a first arm of said second double arm lever unit which has a second arm which is pivotally mounted to a control rod unit which in turn is pivotally mounted to said rocker; and comprising a pressure spring assembly arranged between said rocker and said threaded spindle housing, which pressure spring assembly is adapted to press said rocker with said upper shaft assembly and with the upper feeding roller supported therein onto the lower shaft assembly with said lower feeding roller.

2. The feeding apparatus of claim 1, wherein said threaded spindle is fixedly mounted to a sleeve part which is supported through roller bearings free of play in said threaded spindle housing and said housing, whereby said threaded spindle is positioned.

3. The feeding apparatus of claim 2, wherein said sleeve part is a part of a multi-part clamping sleeve with which a drive shaft of the adjusting motor of an adjusting apparatus projects, which drive shaft is drivingly connected with said multi-part clamping sleeve followed by a jaw clutch coupling to said threaded spindle.

4. The feeding apparatus of claim 1, wherein the second arm of the second double arm lever unit is shaped as forked lever which is pivotally mounted through ball end connections to a respective part of a respective control rod forming a part of a control rod assembly.

5. The feeding apparatus of claim 4, wherein said shaft is sealed against said threaded spindle housing by means of sealing rings, so that said threaded spindle housing forms a closed oil chamber.

6. The feeding apparatus of claim 5, wherein each control rod unit comprises threadingly engaged rod sections allowing a length adjustment.

7. The feeding apparatus of claim 1, wherein the first arm of said first double arm lever unit engages said rod through a bolt which extends through said elongate hole.

* * * * *